US012622495B1

(12) United States Patent
Kitchen

(10) Patent No.: US 12,622,495 B1
(45) Date of Patent: May 12, 2026

(54) QUICK ACCESS WALLET

(71) Applicant: Michael Kitchen, Aston, PA (US)

(72) Inventor: Michael Kitchen, Aston, PA (US)

( * ) Notice: Subject to any disclaimer, the term of this patent is extended or adjusted under 35 U.S.C. 154(b) by 0 days.

(21) Appl. No.: 19/083,333

(22) Filed: Mar. 18, 2025

(51) Int. Cl.
*A45C 11/18* (2006.01)

(52) U.S. Cl.
CPC ..... *A45C 11/182* (2013.01); *A45C 2011/186* (2013.01)

(58) Field of Classification Search
CPC ..... A45C 11/182; A45C 2011/186
USPC ..... 150/147
See application file for complete search history.

(56) References Cited

U.S. PATENT DOCUMENTS

| | | | | |
|---|---|---|---|---|
| 5,020,255 | A | 6/1991 | Rodel | |
| 5,718,329 | A | 2/1998 | Ippolito | |
| 5,938,010 | A | 8/1999 | Osterbye | |
| 6,089,289 | A | 7/2000 | Florjancic | |
| 6,412,627 | B1 | 7/2002 | Tiscione | |
| 9,877,556 | B1 | 1/2018 | Holder | |
| 11,547,188 | B2 | 1/2023 | Myers | |
| 2016/0022000 | A1* | 1/2016 | Tucker-Skow | A45C 11/182 150/147 |
| 2022/0400823 | A1* | 12/2022 | Clarete | A45C 1/06 |

* cited by examiner

*Primary Examiner* — Nathan J Jenness
*Assistant Examiner* — Jessica Kavini Tamil
(74) *Attorney, Agent, or Firm* — PAUL & PAUL

(57) ABSTRACT

The present invention is directed toward an improved quick access wallet that is carried in one's pocket, bag, or purse and is used for carrying standard wallet sized cards. The wallet comprises a rectangular housing base and housing cover that are attached together to form a housing with a card chamber inside and a card opening at a front portion. The card chamber has a first guide wall and a second guide wall which is divided into three portions; a front portion, a recessed portion and a transition portion joining the front portion and recessed portion together. A spring element projects through the first guide wall and urges cards inserted into the card chamber into the recessed portion of the second guide wall, with cards being locked behind the transition portion so they cannot fall out. Another card holding means is provided on the exterior surface of the housing base.

16 Claims, 9 Drawing Sheets

QUICK ACCESS WALLET

BACKGROUND

Field of the Invention

This invention relates to card cases and wallets, and more specifically to wallet-sized electromagnetic shielding or RFID blocking card cases for holding and protecting personal articles such as credit cards, debit cards, chip and pin cards, contactless smartcards, licenses, identification cards, and the like.

Prior Art

Conventional bi-fold and tri-fold wallets and card carriers are primarily designed to hold paper currency, a plurality of cards including credit and bank cards, and other important cards such as a driver's license or IDs, which are not easily replaced if lost. These traditional wallets are typically shaped and sized to be able to fit inside one's pocket for easy transport, and are typically made from a soft leather or fabric material with card pockets on the insides. While convenient for carrying cards and paper currency, these wallets have a number of functional, security, and durability issues including:

a) card pockets are very difficult to get cards out of, and usually force a user to first open the wallet and then dig underneath the edge of a card with their finger in order to get a grip on it and pull it out, making it slow and inconvenient to access a card;

b) card pockets rely on the material of the wallet itself to adequately grip and secure a card or stack of cards, and can make it harder to remove a card if that slot is tight;

c) card pockets pose the risk of cards accidentally sliding out as the card pocket stretches and loosens over time with use;

d) lack of crush resistance if carried in one's back pocket or a bag with other items, which could cause cards inside the wallet to bend or crack over time, affecting their usability;

e) lack of shielding against unauthorized RFID (Radio Frequency Identification) scanning of contactless or RFID enabled credit, bank, or work entry cards, also known in the industry as "skimming" or RFID theft;

f) lack of ergonomics, often requiring two handed operation for finding, accessing, and removing a card from inside the wallet after opening it up.

There are some who have invented more modern quick access wallets and card cases which allow easier card access and attempt to secure cards from falling out. U.S. Pat. No. 6,089,289 issued to Florjancic teaches a plastic holder for two credit cards made of one piece of plastic. The holder takes the form of an injection molded jacket with an intermediate rib at its midpoint which divides the jacket up into two separate card slots. There are cutouts on each side to allow a user to quickly push cards out with their thumb. Inside the card holder is either a flexible follower or a rib that frictionally engages the faces of cards to grip them and prevent them from falling out. The embodiment with the rib as the card gripping method is only able to work with one card, as it bends and deforms that card along its middle access in order to secure it inside the holder. While Florjancic does teach a quick access card holder that is easy to manufacture, the disadvantage of this device is that there is no physical barrier near the card openings to prevent cards from falling out if the device is shaken or dropped—it relies solely on the followers or ribs frictionally engaging the cards. Moreover, if more than one card was stored in each card slot, the stack of cards in each slot would have more weight and a card from that stack would be more likely to slide out from the followers that push down on the topmost card in the stack, leading to a higher chance of cards falling out.

U.S. Pat. No. 6,412,627 issued to Tiscione teaches a rigid card case with a card opening at one end where cards are inserted into a series of parallel slots and a user can eject any card they want by sliding a spring loaded button towards the card opening which corresponds to that card. Tiscione states that cards are kept from falling out of the case by virtue of the sides of cards frictionally engaging a resilient material along the side walls inside the card case, such as resilient pads. While this card case does allow cards to be ejected quickly, there is no physical barrier near the card opening preventing the stack of cards from accidentally sliding out if the internal resilient material or pad wears out, becomes detached from the side wall, or is simply not enough to grip certain cards with slight dimensional variances.

U.S. Pat. No. 9,877,556 issued to Holder teaches a multi-slot quick access wallet made of multiple sheets of thin flexible material. The wallet has an aperture on each side that allows a user to push their cards out quickly. Unfortunately this flexible material (likely leather of fabric) relies on the material itself and the tightness of each card pocket to grip cards, which is unreliable because over time as the wallets' material stretches with use, the card slots can become looser and cards can fall out from their card openings.

U.S. Pat. No. 11,547,188 issued to Myers teaches a rigid card wallet with a window opening and an interior pocket for cards. A pair of internal springs inside the bottom plate of the wallet urge at least one credit card against the top plate in order to prevent the card from falling out. This wallet is similar to that of Florjancics, with an internal spring which can be formed of sheet metal or plastic, and the same problems persist. When adding more than one card to this wallet—for instance 3 or more—the weight of the card stack can be too much for the springs to hold and repetitive shaking motions of the wallet could make cards retained in between other cards in the card slot slide out. This could occur while walking or running with this wallet in your pocket. Once again, there is no physical barrier at the card opening to secure cards in place.

U.S. Pat. No. 5,020,255 issued to Rodel teaches a card holder with a molded body with card channels that cards slide into and are retained in place by a flexible retaining tab with a lug on its distal end. This retaining tab is able to be pulled down with one's finger to allow cars to be inserted and removed, but by no means is this convenient; while Rodel teaches a physical barrier at the card insertion area so cards cannot fall out, it must be pulled down manually in order to push cards out. This is inconvenient and also not practical for storing several cards, as two handed operation is needed. Moreover, as a result of compressive forces on the wallet from being stored in one's pocket or bag, the retaining tab could be unintentionally bent downwards and allow cards to slide out from the card holder, since the retaining tab is greatly exposed. The required two handed operation also makes shuffling through cards that are under the topmost card even more difficult.

Hence, there exists a need for a wallet or card holder that allows a user to access their cards quickly and intuitively, yet provides a reliable physical barrier to prevent cards from falling or sliding out accidentally. The proposed wallet must not have any flaps, panels, or locks that must be opened first before accessing a card, and cards must be able to bypass this physical barrier when needed without any difficulty or added steps.

SUMMARY OF THE INVENTION

The present invention is directed toward an improved quick access wallet that is carried in one's pocket, bag, or purse and is used for carrying standard wallet sized cards. Standard wallet sized cards are the most commonly used cards and are 2⅛" wide by 3⅜" long with small rounded corners. A currently preferred embodiment of the wallet comprises a housing which includes a housing base and a housing cover which are attached to one another. The housing base has a generally rectangular shape with a front portion, a rear portion, and a bottom portion that has an interior surface and an exterior surface, as well as a pair of sides. The housing cover has a generally rectangular planar shape with a pair of side walls upstanding from its two longitudinal sides. The housing cover substantially covers the interior surface of the bottom portion of the housing base as well as the sides of the housing base. The side walls of the housing cover extend between the front and rear portions of the housing base to form a card chamber. The interior surface of the bottom portion of the housing base serves as the bottom surface of the card chamber. A card opening is formed through the front portion of the housing base. In a preferred embodiment, the housing cover has a finger aperture which allows a user to eject cards out quickly and easily from the card chamber.

Inside the card chamber is a first guide wall, a second guide wall and a rear wall all upstanding form the interior surface of the bottom portion of the housing base, with the rear wall extending from the first guide wall to the second guide wall. The guide walls help guide cards into the card chamber and the rear wall acts as a barrier or stop for the cards. The second guide wall is divided into three parts; a front portion, a recessed portion and a transition portion which joins the front portion to the recessed portion. The first guide wall has a spring element projecting through it for urging cards received into the card chamber against the recessed portion of the second guide wall to retain them. The transition portion of the second guide wall acts as a physical barrier to prevent cards from sliding out of the card chamber and can be bypassed by exerting a pushing force on the cards which forces the cards to slide against and frictionally engage the transition portion and push the spring element backwards and away from the card chamber and allow cards to bypass the transition portion and be removed from the recessed portion of the second guide wall so they can be ejected from the wallet.

The exterior surface of the bottom portion of the housing base has a pair of card rails upstanding from it for retaining additional less important cards, such as work access cards or loyalty cards.

The longitudinal edges of the housing cover comprises a rounded exterior edge to keep the wallet edges soft, comfortable, and ergonomic to hold in one's hand. The housing cover is made from a substantially rigid RFID protective material such as aluminum, steel, titanium, or carbon fiber reinforced material, so that cards stored inside are shielded from unauthorized RFID scanning.

In one aspect, the present invention provides a quick access wallet that holds a plurality of cards that can be accessed quickly and without complication while also providing a reliable physical barrier to prevent cards from falling or sliding out accidentally.

In another aspect, the present invention allows cards stored inside the wallet to instantly bypass the physical barrier and be ejected with only one step.

In another aspect, the present invention ensures the wallet is crush resistant to protect cards stored inside from being crushed, cracked, or bent with use.

In another aspect, the present invention makes the housing cover out of a substantially rigid material with inherent RFID shielding properties, such as aluminum, titanium, steel, or carbon fiber so that all cards stored inside the wallet are protected from crushing forces and shielded from unauthorized RFID scanning.

In another aspect, the present invention provides a card removal means to allow a user to eject and shuffle cards out from the card chamber.

In another aspect, the present invention allows easy assembly of the wallet without the use of fasteners, adhesives, or screws, which greatly reduces manufacturing and assembly costs and eliminates issues such as screws becoming loose over time and falling out.

These aspects of the invention are realized in a presently preferred embodiment of the invention, while other embodiments may only realize some of these aspects.

DETAILED DESCRIPTION

Figure 6:
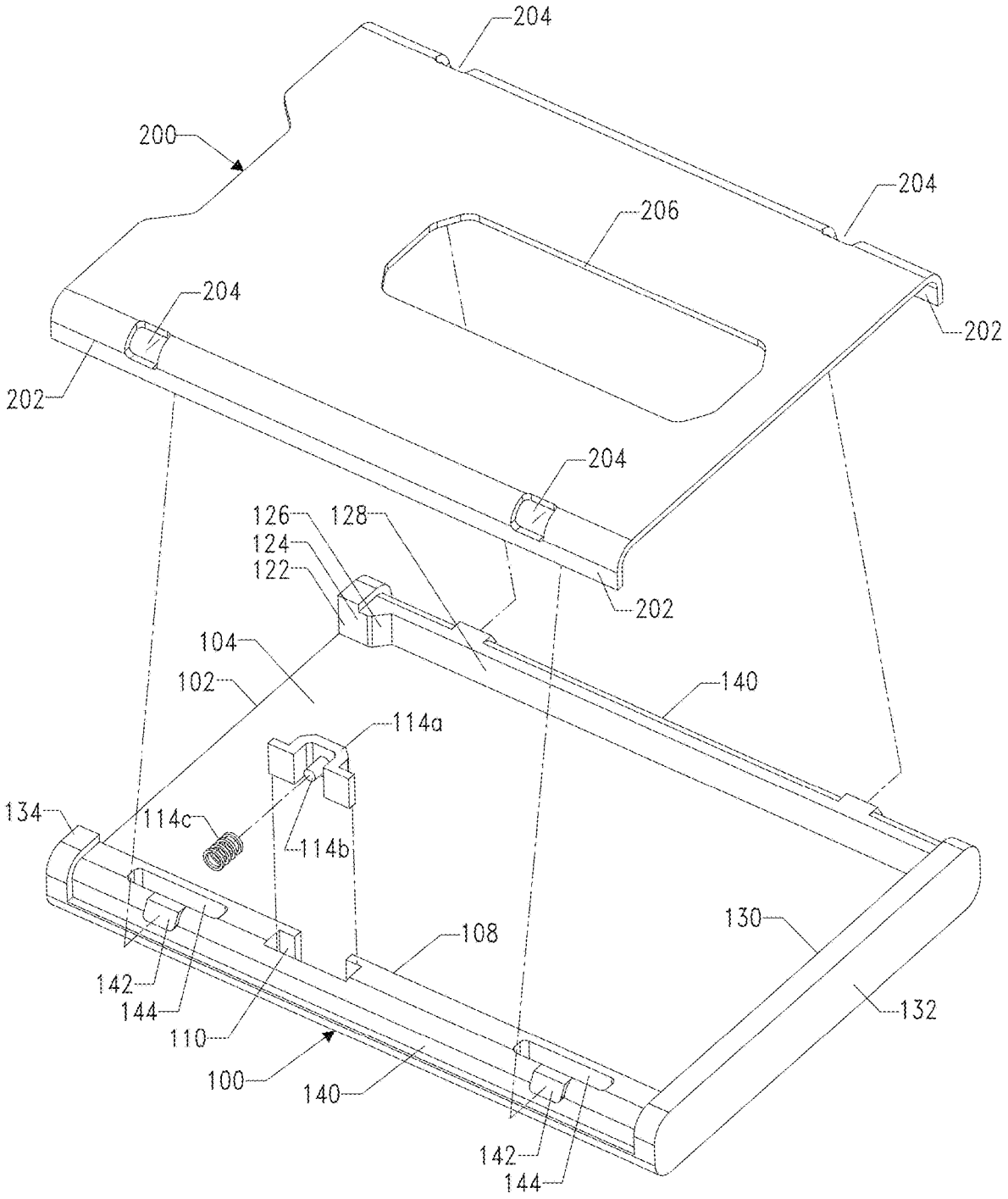
FIG. 6 is an exploded perspective view of the wallet of FIG. 1 showing the spring element being inserted into the housing base and the housing cover being attached to the housing base.

A quick access wallet 300 which is a presently preferred embodiment of the present invention is shown in FIGS. 1, 1A, 2, 3, 4, 4A and 4B. FIG. 6 shows an exploded view of wallet 300 separated into its individual components—the housing base, housing cover, and spring element.

Figure 1:
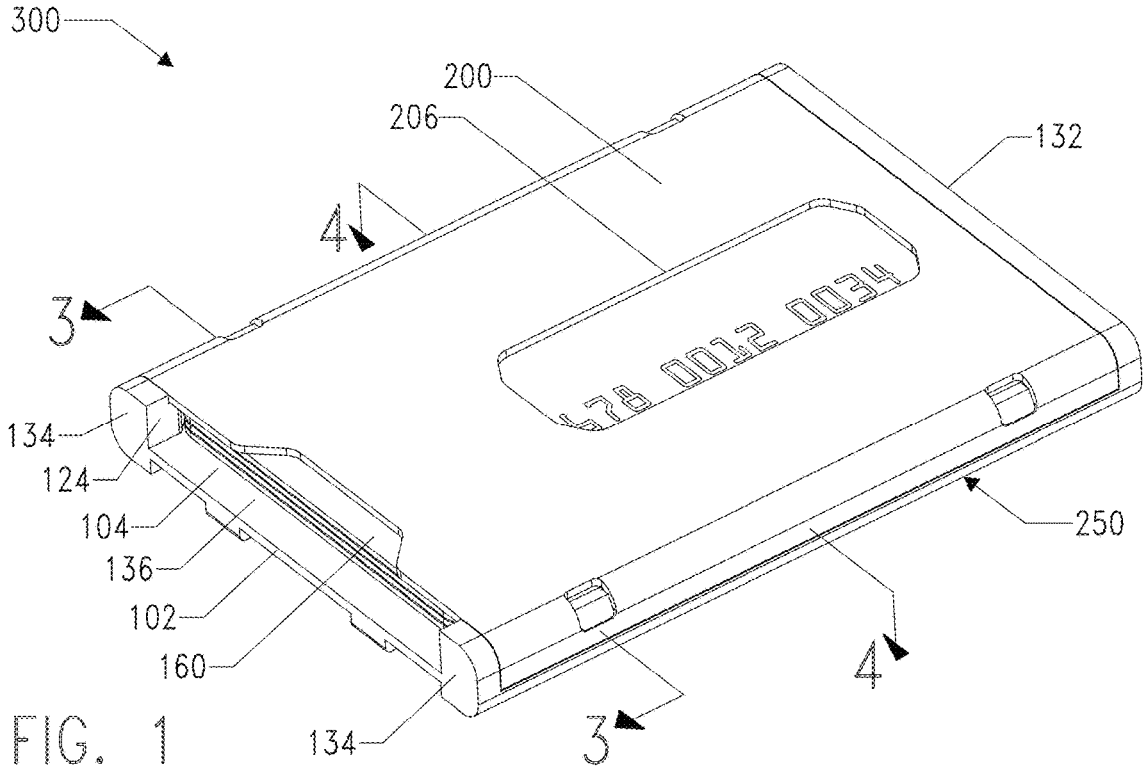
FIG. 1 is a perspective isometric view of the front side of an embodiment of the wallet of the present invention.
Figure 1A:
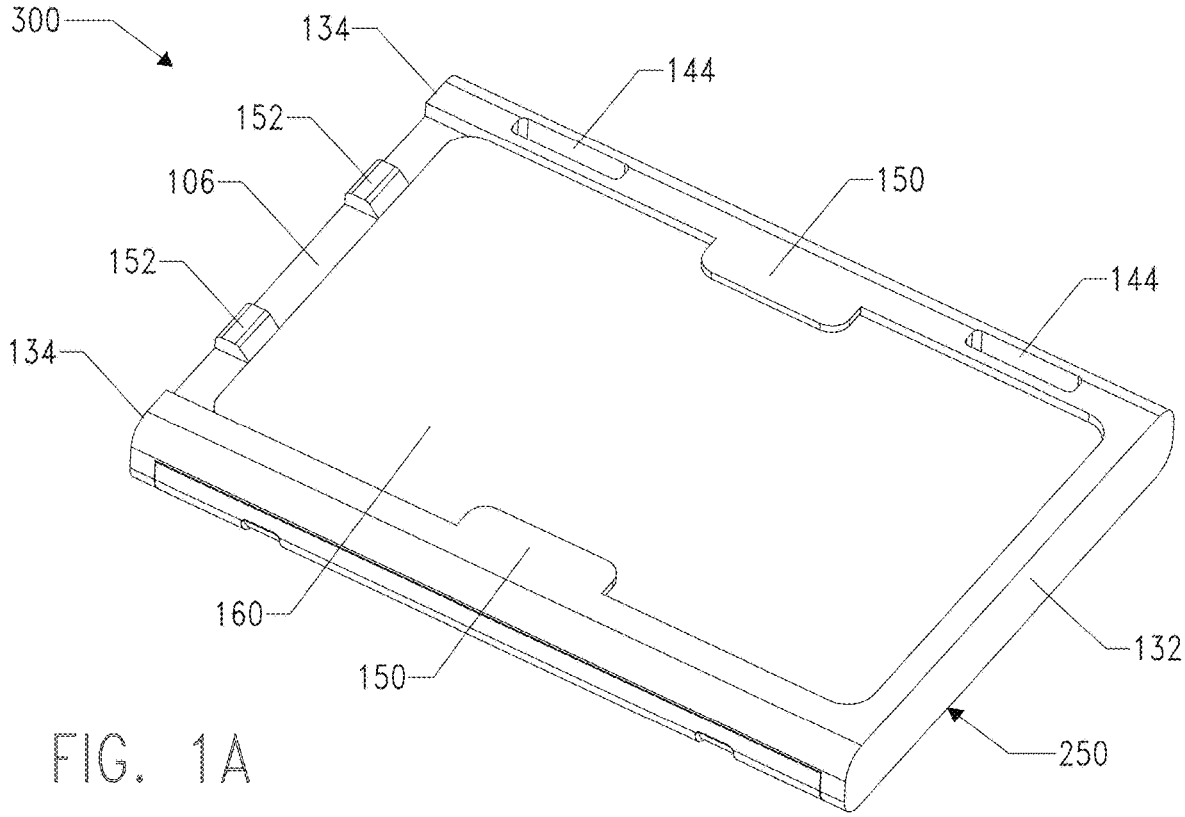
FIG. 1A is a perspective isometric view of the rear side of the wallet of FIG. 1.
Figure 2:
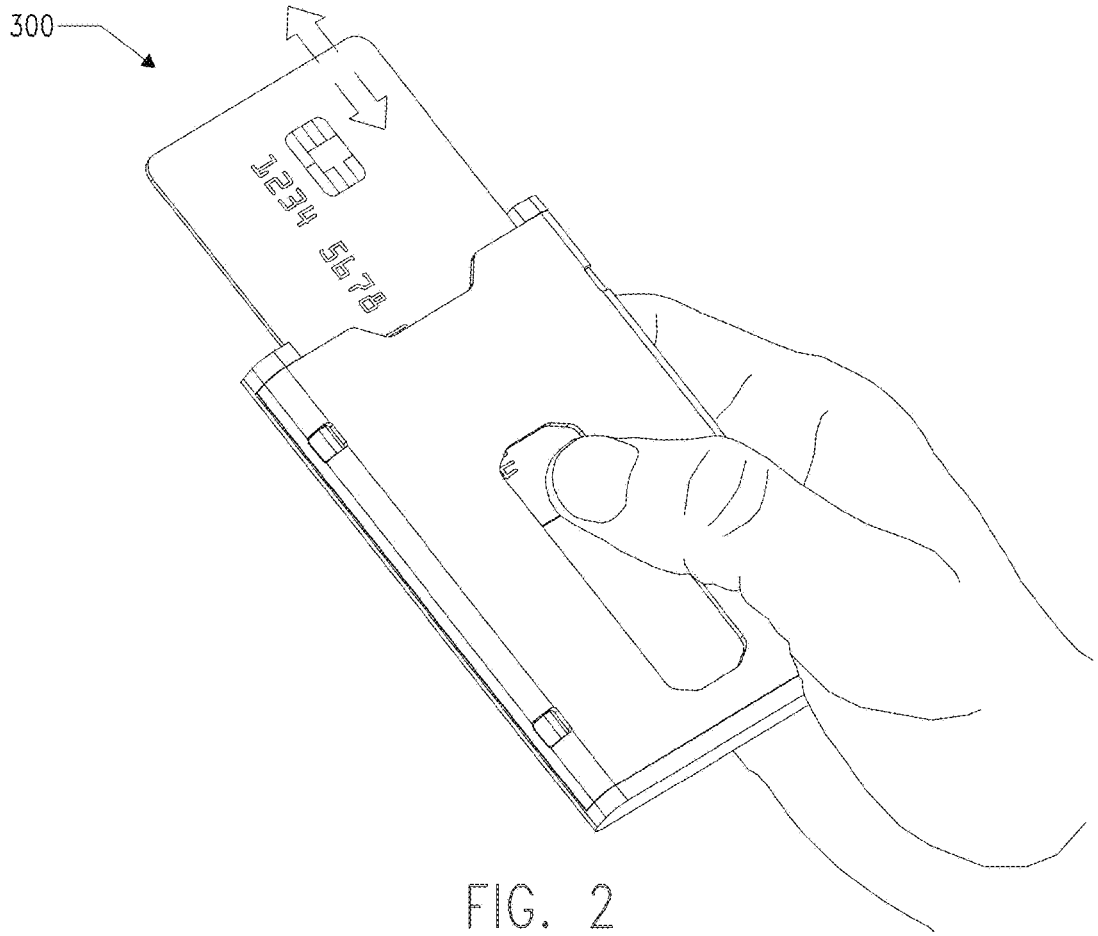
FIG. 2 is a perspective isometric view of the wallet of FIG. 1 illustrating a credit card being ejected out of the wallet by a user.
Figure 3:
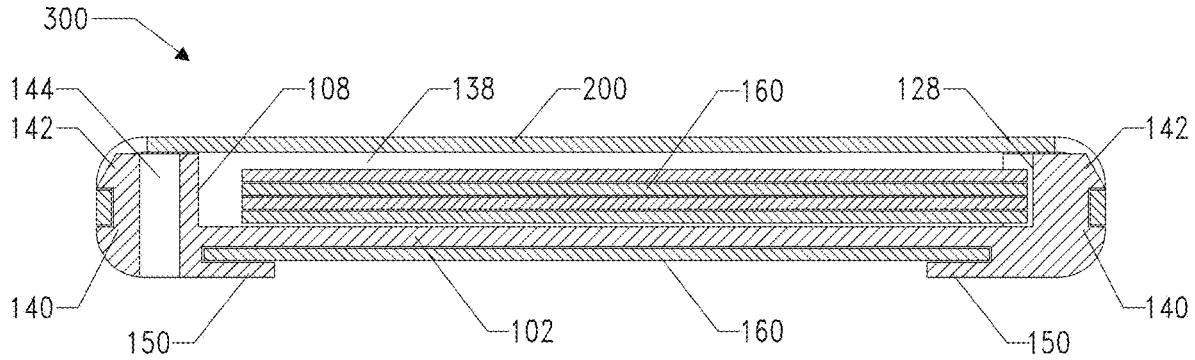
FIG. 3 is a vertical section taken along the line 3-3 of FIG. 1, when cards are fully inserted into the card chamber.

Housing base 100, as seen in FIG. 6, has a generally rectangular planar shape and comprises two longitudinal sides 140 and two transverse ends and has a bottom portion 102 (seen in FIGS. 1,3 and 6) with an interior surface 104 (seen in FIGS. 1,4 and 6) and an exterior surface 106 (seen in FIG. 1A). The housing base 100 further comprises a front portion 134 and a rear portion 132. A first guide wall 108 and a second guide wall 122 are upstanding from the interior surface 104 on opposing sides of each other and are joined together by a rear wall 130, as seen in FIGS. 4, 4A, 4B and 6. A plurality of protrusions 142 project outwards from the sides 140 of the housing base 100. On one of the longitudinal sides 140 of housing base 100 are relief holes 144 located directly behind protrusions 142 and which are formed completely through the housing base 100. Relief holes 144 allow the protrusions 142 on one side of the housing base 100 to temporarily flex backwards and then return. In a preferred embodiment, a pair of card rails 150 extend partially over top of the exterior surface 106 and are configured to receive at least one card. A pair of card ramps 152 help retain cards stored under the card rails 150 against exterior surface 106, as shown in FIG. 1A. It should be noted that the rear wall 130 does not need to extend continuously between first guide wall 108 and second guide wall 122, but it is preferable as it creates better strength and rigidity to the housing base 100.

A housing cover 200, shown in FIG. 6, has a generally rectangular planar shape with two longitudinal sides and two transverse ends. In a preferred embodiment, a finger aperture 206 is provided through the center of the housing cover 200. Along the two longitudinal sides of the housing cover 200 are side walls 202. The side walls 202 have apertures 204 (seen in FIG. 6) that are sized and positioned to receive the protrusions 142 on the housing base 100.

As suggested by FIG. 6, the housing cover 200 is firmly attached to the housing base 100 by pushing the two components together and allowing the inner surfaces of the side walls 202 on housing cover 200 to frictionally engage with and push backwards the pair of protrusions 142 with relief holes 144 behind them until all protrusions 142 are aligned with and forced through apertures 204. When housing cover 200 has been attached to the first housing base 100 it creates a housing 250 (seen in FIGS. 1 and 1A), and the housing cover 200 substantially covers the interior surface 104, first guide wall 108, second guide wall 122 and the longitudinal sides 140 of the first housing base 100 and extends between the front portion 134 and the rear portion 132 to form a card chamber 138. The card chamber 138, seen in FIGS. 3, 4, 4A and 4B, is defined on its sides by first guide wall 108 and second guide wall 122, on its rear by rear wall 130, on its bottom by interior surface 104 and on its top by housing cover 200. The front portion 134 of housing base 100 comprises a card opening 136 formed therein (seen in FIG. 1) through which cards can be slidably inserted and removed from card chamber 138.

Figure 4:
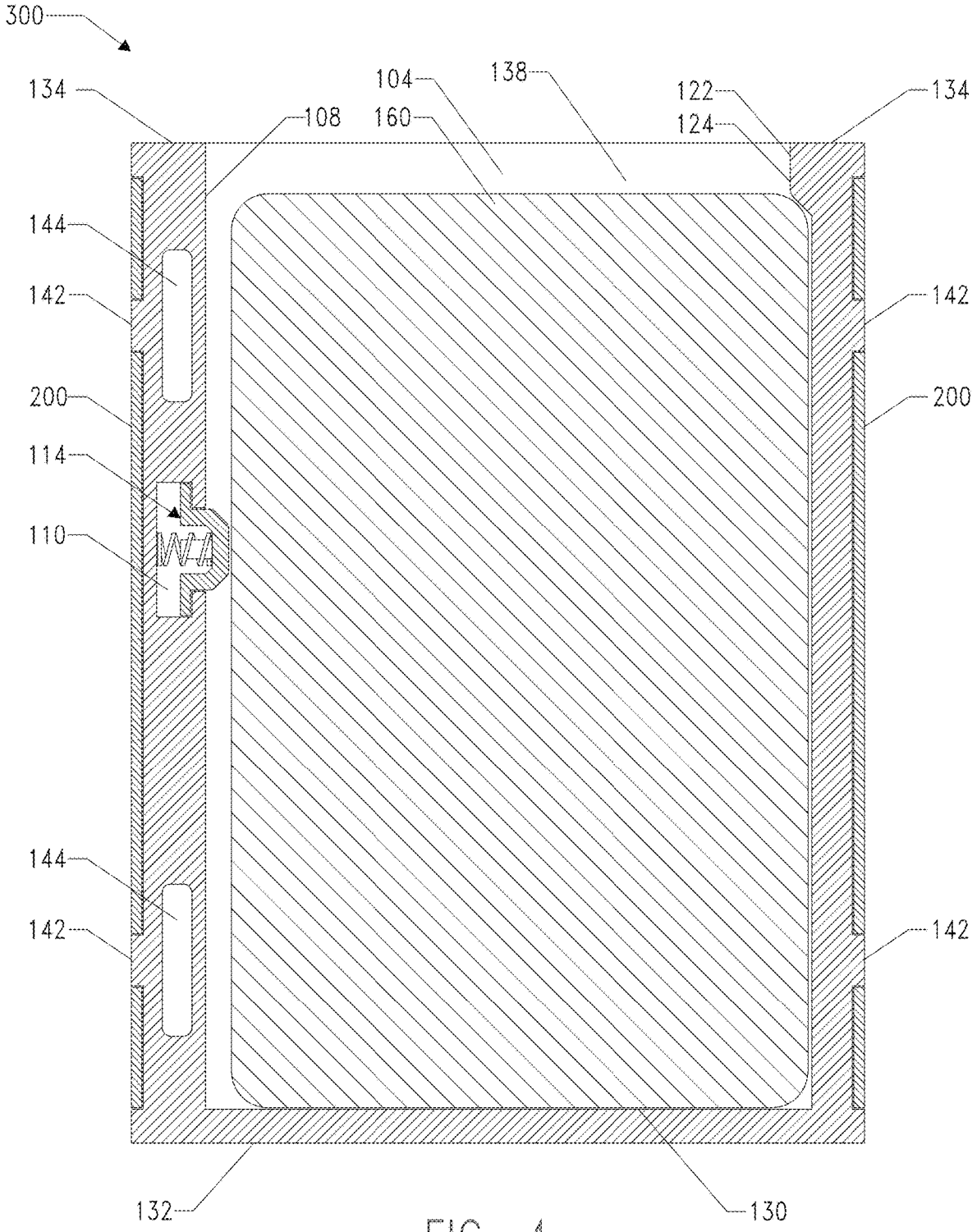
FIG. 4 is a horizontal sectional plan view taken along the lines of 4-4 of FIG. 1 through the card chamber showing the manner in which a plurality of cards are urged against the recessed portion of the second guide wall and retained.
Figure 4A:
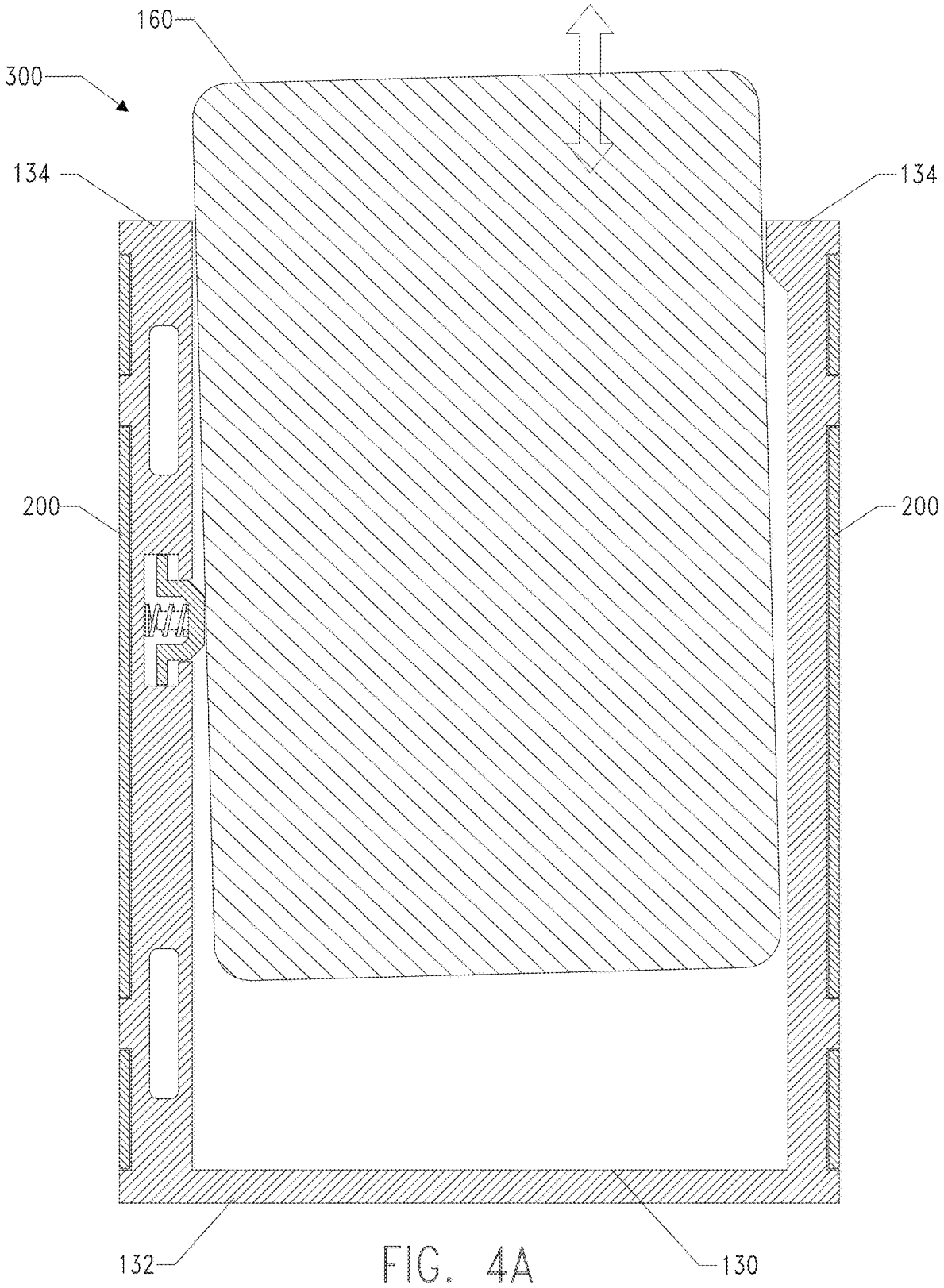
FIG. 4A is a horizontal sectional plan view similar to FIG. 4 showing a card slightly rotating counterclockwise while being pushed out from the card chamber causing the spring element to slide backwards so cards can be removed from within the recessed portion of the second guide wall.
Figure 4B:
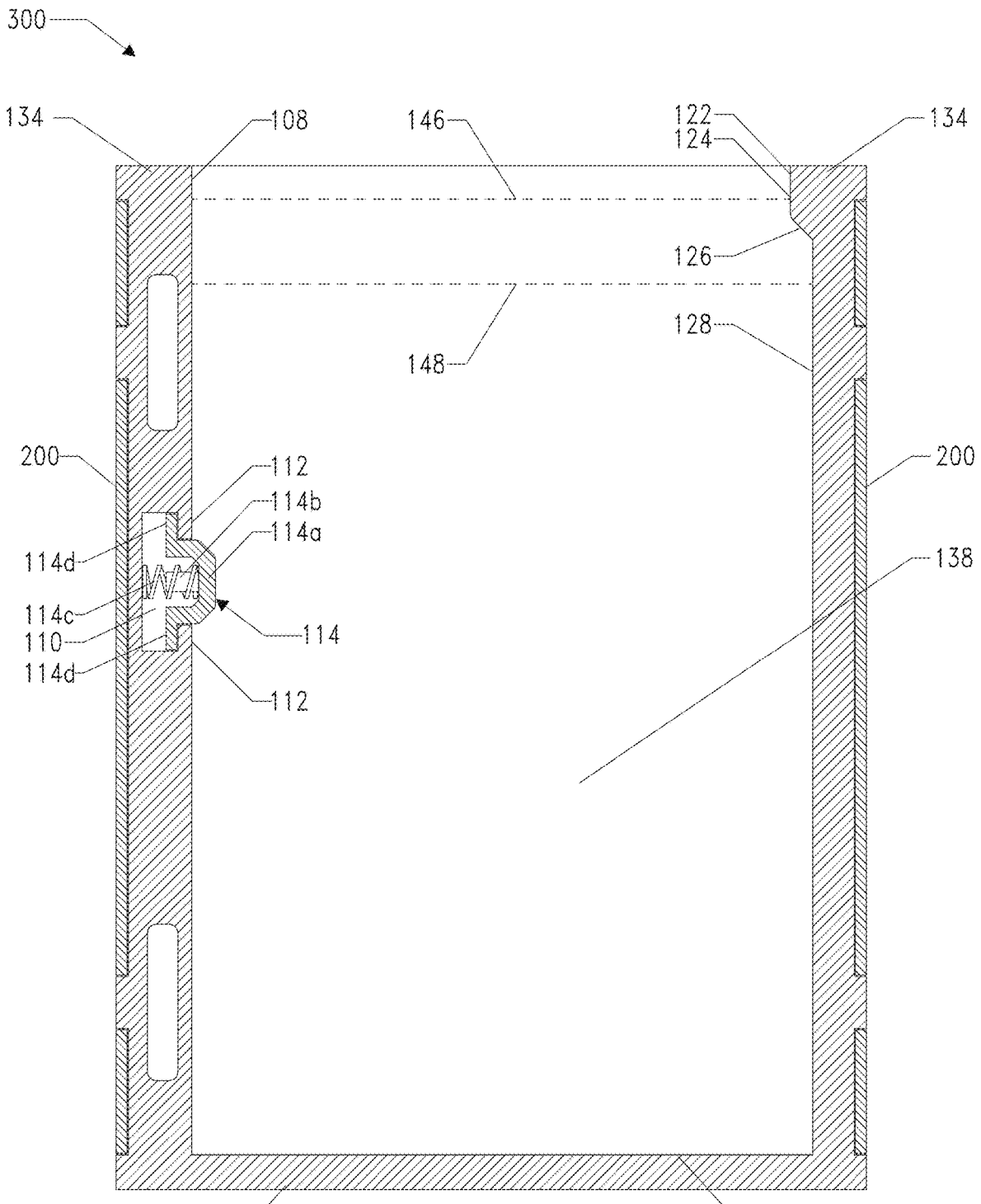
FIG. 4B is a horizontal sectional plan view similar to FIG. 4 but with no cards stored inside the card chamber, and showing the first predetermined distance and the second predetermined distance as well as the spring element and all of its corresponding parts.

As seen in FIG. 4B, the first guide wall 108 has a recess 110 formed therein, with retaining walls 112 on each of its sides. A spring element 114 is slidably retained inside recess 110 and projects from the first guide wall 108 and into the card chamber 138. In a preferred embodiment, the spring element 114 comprises a sliding member 114*a* with end walls 114*d*, a boss 114*b* on its back, and a compression spring 114*c*. As seen in FIG. 4B, the compression spring 114*c* wraps around boss 114*b* on the back of the sliding member 114*a* and urges against a rear portion of recess 110 to constantly force spring element 114 to project through the first guide wall 108 and into the card chamber 138. In a preferred embodiment, the sliding member 114*a* is able to slide into and out of the recess 110. The retaining walls 112 on the edges of recess 110 contact the end walls 114*d* to help retain sliding member 114*a*.

The second guide wall 122 is comprised of three portions; a front portion 124 which parallels the first guide wall 108 at a first predetermined distance 146 (seen in FIG. 4B), a recessed portion 128 spaced at least a second predetermined distance 148 from the first guide wall 108 (seen in FIG. 4B), and a transition portion 126 joining the front portion 124 to the recessed portion 128 (also seen in FIG. 4B).

Functionality

As seen in FIG. 4A, as cards 160 are inserted through the card opening 136 and into the card chamber 138, the first guide wall 108 and the front portion 124 of second guide wall 122 help guide cards into the wallet 300. As they are being inserted, cards 160 eventually engage the angled edge of sliding member 114*a* and forces it to move backwards into the recess 110. During this process the cards being inserted may start to rotate slightly counterclockwise into the recessed portion 128 of the second guide wall 122 (seen in FIG. 4A) but still remain mostly parallel with guide walls 108 and 124. Once cards 160 are fully inserted into the card chamber 138 and fully clear the front portion 124, the cards slightly rotate clockwise into the recessed portion 128 and the spring element 114 urges cards 160 against the recessed portion 128. As can be seen in FIG. 4, while the spring element 114 is urging cards against the recessed portion 128, the transition portion 126 acts as a physical barrier which essentially locks cards in the card chamber against the recessed portion 128. This prevents cards from sliding out of the wallet. The front portion 124, transition portion 126 and the recessed portion 128 are not able to retain cards on their own or in combination with each other, and require the force of spring element 114 to keep cards securely retained. Moreover, when cards are fully inserted into the card chamber 138 and are being retained against the recessed portion 128, there exists a small gap between the edges of cards and the first guide wall 108, which can be seen in FIG. 3 and FIG. 4.

Figure 5:
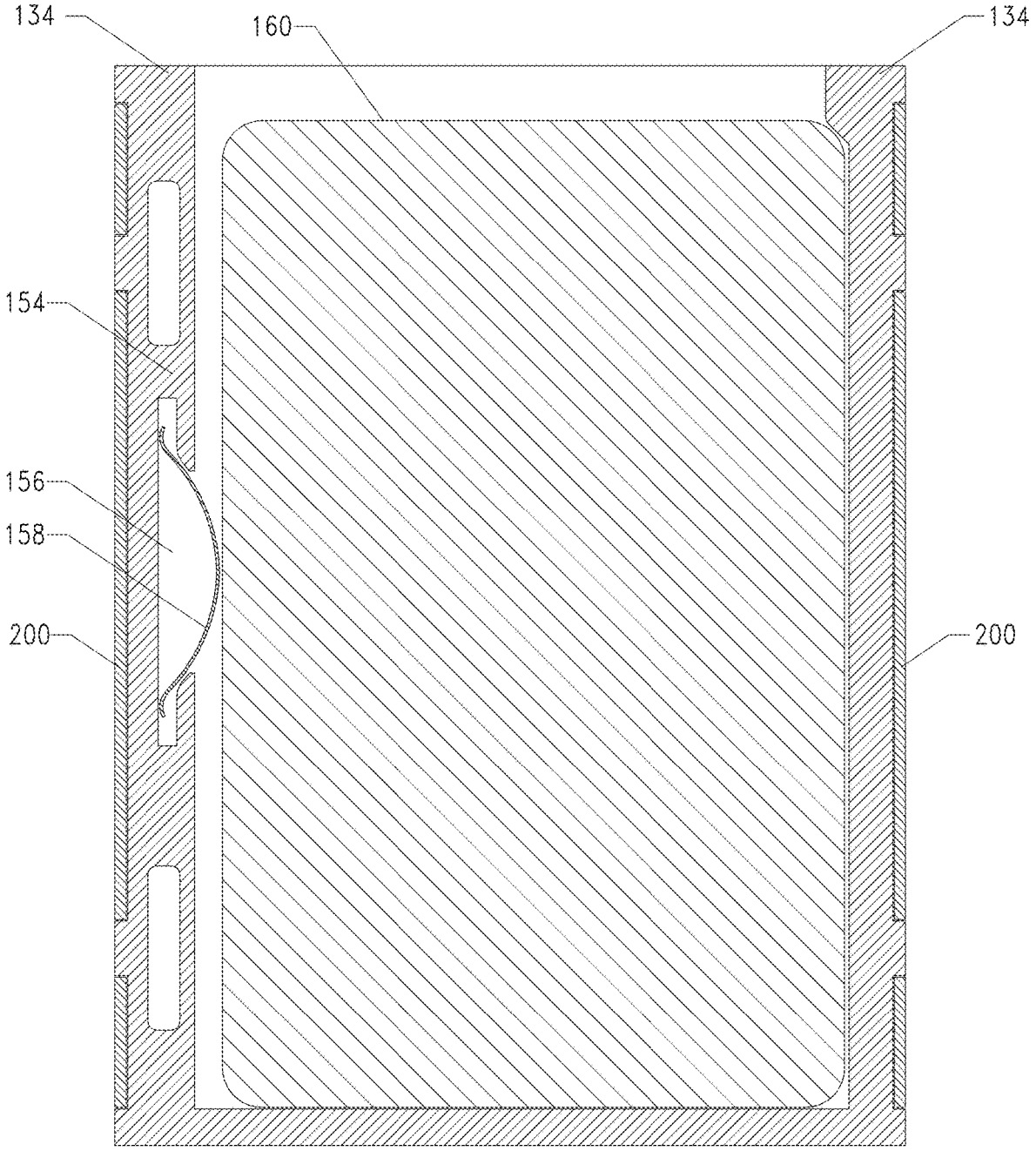
FIG. 5 is a horizontal sectional plan view through an alternate embodiment of the housing base showing a different recess in the first guide wall and a steel spring acting as the spring element.

An alternate embodiment of housing base 100 is shown in section in FIG. 5 and denoted by the numeral 154. In this embodiment, the housing base 154 is the same as housing base 100 except the new recess 156 is sized and shaped differently, and the spring element 114 is omitted in lieu of a steel spring element 158 which is retained in the new recess 156 and is used to urge against a stack of cards 160 inside the card chamber. This method produces a similar result as spring element 114 but is one single component, which could save on manufacturing and assembly costs.

Figure 5A:
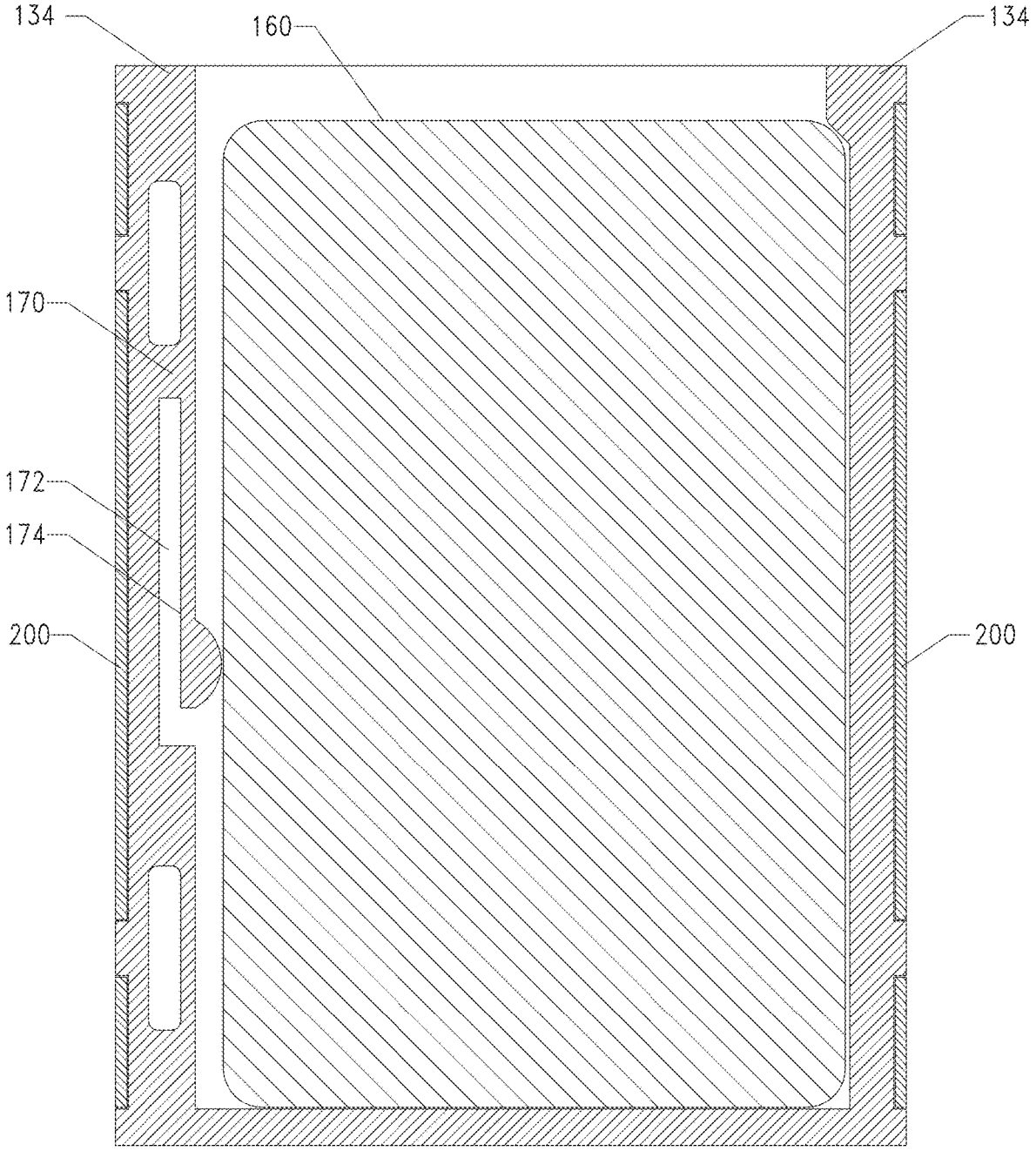
FIG. 5A is a horizontal sectional plan view through another alternate embodiment of the housing base showing an integrated spring element on the first guide wall.

Another embodiment of housing base 100 can be seen in FIG. 5A and is denoted by the numeral 170. In this embodiment, the housing base 170 has an integrally formed integrated spring element 174 and has the ability to flex backwards into a new recess 172 and then return, similar to a snap fit in injection molded plastic parts. The integrated spring element 174 may have a little nub on its end extending into the card chamber which urges cards against the recessed portion of the second guide wall. This embodiment allows the spring element and the housing base to be formed as one piece and saves on manufacturing and assembly costs.

In yet another alternate embodiment, a flexible piece of soft rubber, such as having a shore A durometer value off 40 or less, could be placed in the recess of housing base 100 or affixed to an area near it and would be capable of deforming when cards are inserted into the card chamber and then return to its original state once cards are fully inserted to keep cards pressed into the recessed portion 128 of the second guide wall 122 (not shown).

In a preferred embodiment, the transition portion 126 of the second guide wall 122 is angled approximately 45 degrees with respect to the interior surface 104 of the card chamber 138, which greatly facilitates engaging the corners of cards being pushed out from the card chamber 138. In a preferred embodiment, to eject cards out a user must put their finger through finger aperture 206 on housing cover 200 and physically push the topmost card in the stack of cards 160 towards the card opening 136 (seen in FIG. 2). While initiating this action, the card being ejected will start to move forwards and slightly rotate counterclockwise once it frictionally engages the transition portion 126 while simultaneously pushing spring element 114 backwards into recess 110, which allows cards being ejected to bypass and go around the transition portion 126. The topmost card stored inside the card chamber 138 should be one of the users most frequently used cards.

Cards stored underneath the topmost card in the card chamber 138 are easily accessed by pushing out the topmost card first until the finger aperture 206 shows the next card underneath, at which point that card can also be pushed out with one's finger and accessed underneath the topmost card which is already partially ejected from the card opening 136. This process is repeated for each subsequent card remaining in the stack. This allows a user to easily shuffle through cards if they need a card underneath the topmost card in a stack.

In a preferred embodiment, it is important that the force required to eject or push one card out of the card chamber is not so great that it becomes difficult or strenuous for the user. That is why the recessed portion 128 should not be so deep or recessed that it becomes difficult or even physically impossible for cards to bypass transition portion 126. Moreover, it's important that the recessed portion 128 is not so shallow that cards can easily bypass transition portion 126 and fall out of the wallet. To avoid these issues and ensure a balance between smooth ejection and reliable retaining of cards, the second predetermined distance 148 (seen in FIG. 4B) is preferably 0.025" to 0.1875" longer than the first predetermined distance 146 (also seen in FIG. 4B). Through research and prototyping, it is apparent that this dimensional range allows for the best balance of retaining cards and easy ejection. Any dimension outside of that range risks functional issues; a dimension too small will make recessed portion 128 too shallow and cards can bypass transition portion 126 easily if the wallet 300 is dropped or bumped while in one's pocket or bag, and a dimension too large will make cards difficult or impossible to eject as transition portion 126 becomes too wide of a physical barrier for cards to easily bypass.

In a preferred embodiment, the first guide wall 108, and the front portion 124, transition portion 126 and the recessed portion 128 of the second guide wall 122 are all stationary and do not move, flex or deform. Also in a preferred embodiment, the first predetermined distance 146 between the first guide wall 108 and the front portion 124 is approximately slightly wider than the width of a standard wallet size card. As previously described, standard wallet sized cards are typically 2⅛" wide and 3⅜" long with small rounded corners. Moreover, it is preferred that the length of the recessed portion 128 is almost the length of a standard wallet sized card so that a stack of cards can fit snugly against the recessed portion 128 and the transition portion 126 and not move or rattle loose while inside the wallet. In a preferred embodiment, the front portion 124 of the second guide wall 122 is between 1/16 and ¼ inches long, but can vary slightly in other embodiments. It is preferable for the front portion 124 of the second guide wall 122 to have some length to it to help smoothly guide cards into and out of the card chamber 138.

Figure 7:
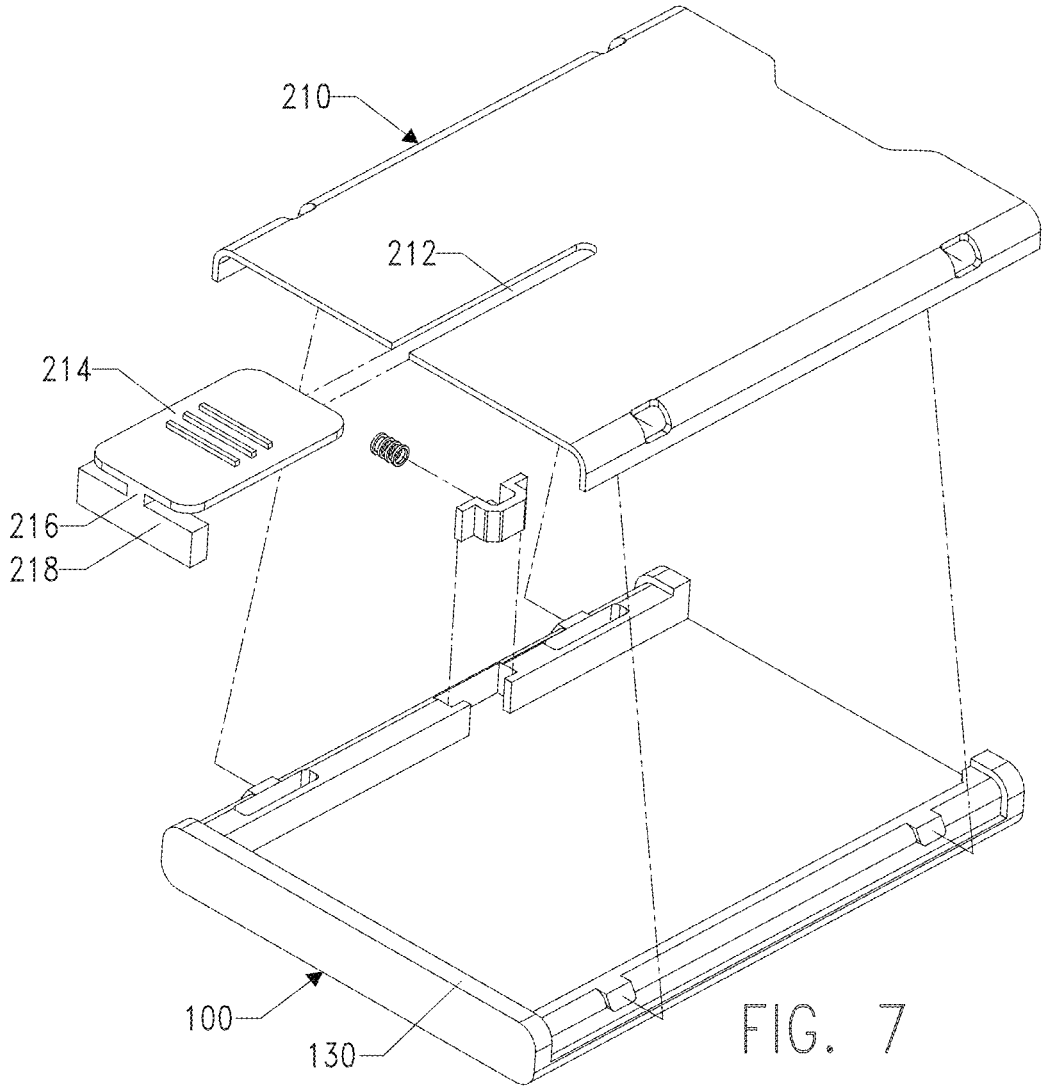
FIG. 7 is an exploded perspective view of an alternate embodiment of the wallet showing the spring element being inserted into the housing base and the button and alternate embodiment of the housing cover being attached to the housing base.
Figure 8:
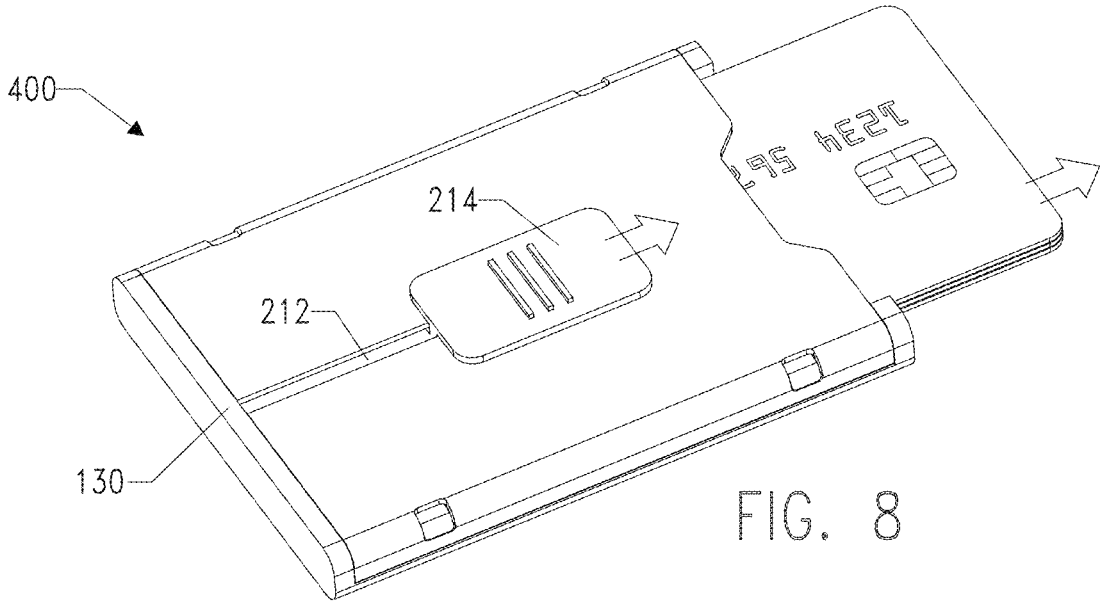
FIG. 8 is a perspective isometric view of an alternate embodiment of the wallet illustrating a stack of cards being ejected out of the wallet when the button is moved forwards.

An alternate embodiment of the wallet of the present invention is shown in FIGS. 7 and 8 and broadly denoted by the numeral 400. This embodiment differs from the presently preferred embodiment in that the housing cover 200 is replaced with a new housing cover 210 which omits the finger aperture 206 and replaces it with a slit 212, and a button 214 is added as a means for ejecting cards out instead of using your finger through finger aperture 206. As can be seen in an exploded view in FIG. 7, the button 214 has a rib 216 extending underneath it which connects to ejecting member 218. The rib 216 is shaped and sized to be received by slit 212 as button 214 slides into place against the top surface of housing cover 210. After the housing cover 210 is snapped firmly into place against the housing base 100, rear wall 130 abuts up against the end of slit 212 (seen in FIG. 8) and ejecting member 218 is then disposed underneath the housing cover 210 to keep the button 214 retained on top of the housing cover 210. When the button 214 is pushed forward with one's finger it causes the ejecting member 218 to push against the back edges of a stack of cards in the card chamber and force them out of the card opening. Aside from the addition of the new housing cover 210 and button 214, all other elements of this embodiment are the same as the preferred embodiment. This is a useful embodiment for ejecting all of the cards out from the card chamber at once, instead of just one at a time.

In another embodiment, the button 214 and slit 212 are relocated to other areas of the housing cover such as through one of the side walls (not shown). In yet another embodiment, the finger apertures 206 are omitted and a lever arm is pivotably mounted inside the housing at the back of the card chamber behind cards and is able to be rotated in various ways to push the stack of cards out (not shown).

In yet another alternate embodiment, card rails 150 and ramps 152 are eliminated from the exterior surface 106 and a traditional steel money clip is attached for holding paper currency against exterior surface 106 (not shown). In yet another alternate embodiment, card rails 150 and ramps 152 are once again eliminated and a plurality of magnets are embedded or insert molded into the bottom portion 102, and the wallet is able to be attached to the back of mobile devices configured with a magnetic attachment system (not shown).

Materials and Manufacturing

In a preferred embodiment, the housing cover 200 is stamped and formed from a uniform sheet of substantially rigid metal alloy such as aluminum, titanium, or steel. A carbon fiber reinforced material can also be used. Aluminum alloy has strong inherent RFID shielding properties and is lightweight, rigid, resilient, and readily available. It is also one of the most recyclable materials, making it a "greener"

material. The lightness of the material chosen is also favorable as the wallet 300 is meant to be comfortably carried in one's pocket or handbag. If the housing cover 200 was made from aluminum, it would also be able to undergo an anodizing process resulting in different colors to satisfy new trends, demands and tastes of the market.

Also in a preferred embodiment, the housing base 100 and sliding member 114*a* are both injection molded from a durable, lightweight, and resilient plastic such as ABS or polycarbonate.

In a preferred embodiment, the housing cover 200 is attached to the housing base 100 using protrusions 142, without the use of any fasteners, screws, adhesive or welding. This makes wallet 300 easier to manufacture than most competing products in the market. In another embodiment, the housing cover 200 can be attached to the housing base 100 using screws or other fasteners.

Moreover, in yet another embodiment, the housing base 100 and a spring element is inserted into a single piece housing formed by a metal molding process, a CNC machining process or an aluminum extrusion process (not shown). This alternate embodiment of the housing may wrap around the housing base to some degree or may completely envelope it.

The present invention thus provides a quick access wallet that can be used to quickly access cards with minimal complication or deterrence, while also providing a reliable physical barrier that retains cards inside and prevents them from falling out. Furthermore, in some embodiments, the wallet has several additional advantages such as:

- The configuration of this invention allows cards to easily be pushed out and bypass the physical barrier when a card is needed, without needing to interact with flaps, tabs, buttons, zippers or locks;
- The construction and materials selected to manufacture the wallet allow it to be substantially rigid and crush resistant, protecting all the cards inside from being crushed, bent, or cracked;
- All cards stored inside the wallet are shielded from unauthorized RFID scanning, preventing what is known in the industry as RFID theft or skimming;
- The wallet is easily and firmly assembled together without the use of fasteners, adhesives, screws or welding which greatly reduces manufacturing costs and eliminates issues such as screws becoming loose over time and falling out.

Additional cards can be stored on the exterior surface of the wallet, providing an ideal location for work entry cards or public transportation passes.

Using one's thumb to vertically remove cards from the card chamber is fast and intuitive, mimicking the same gesture millions of people already use when scrolling up or down with their thumbs while on their mobile phones; The housing cover, if made from aluminum, can be anodized in different colors to meet the current trends, demands and tastes of the market.

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention. Accordingly, the scope of the invention should be determined not by the embodiment illustrated, but by the appended claims and their legal equivalents.

REFERENCE NUMERALS

100 housing base
102 bottom portion of housing base
104 interior surface of housing base
106 exterior surface of housing base
108 first guide wall
110 recess in first guide wall
112 retaining walls in recess
114 spring element
114*a* sliding member
114*b* boss on sliding member
114*c* compression spring
114*d* end walls on sliding member
122 second guide wall
124 front portion of second guide wall
126 transition portion of second guide wall
128 recessed portion of second guide wall
130 rear wall
132 rear portion of housing base
134 front portion of housing base
136 card opening
138 card chamber
140 sides of housing base
142 protrusions
144 relief holes
146 first predetermined distance
148 second predetermined distance
150 card rails
152 card ramps
154 second embodiment of housing base
156 recess in second embodiment of housing base
158 steel spring element
160 cards
170 third embodiment of housing base
172 recess in third embodiment of housing base
174 integrated spring element
200 housing cover
202 side walls on housing cover
204 apertures in side walls
206 finger aperture in housing cover
210 second embodiment of housing cover
212 slit in housing cover
214 button
216 rib under button
218 ejecting member
250 housing
300 wallet
400 alternate embodiment of wallet

The invention claimed is:

1. A quick access wallet comprising:

a housing;

the housing comprising:

a housing base having a generally rectangular planar shape including a pair of longitudinal sides and a pair of transverse ends;

the housing base having a bottom portion having an interior surface and an exterior surface, a rear portion, and a front portion;

a housing cover having a generally rectangular planar shape and attached to the housing base, the housing cover covering the interior surface of the housing base;

the front portion of the housing base having a card opening formed therein configured to allow cards to pass through the card opening and into and out of a card chamber configured to receive at least one card, the interior surface of the bottom portion of the housing base forming a surface of the card chamber;

the card chamber having a first guide wall, a second guide wall, and a rear wall all upstanding from the interior surface of the housing base, the rear wall being disposed between the first guide wall and the second guide wall proximate to the rear portion of the housing base;

the second guide wall having at least three portions, the three portions including a front portion of the second guide wall paralleling the first guide wall at a first predetermined distance and being proximate to the card opening, a recessed portion spaced at least a second predetermined distance from the first guide wall, and a transition portion joining the front portion of the second guide wall to the recessed portion, the second predetermined distance being greater than the first predetermined distance;

a spring element projecting from the first guide wall and into the card chamber for urging cards received within the card chamber towards the second guide wall to rotate and lock cards that are fully inserted into the card chamber against the recessed portion of the second guide wall, the transition portion of the second guide wall forming a physical barrier locking the cards in the card chamber against the recessed portion.

2. The quick access wallet of claim 1, wherein the wallet further comprises a card a removal means for urging cards received within the card chamber toward and out from the card opening.

3. The quick access wallet of claim 2 wherein the card removal means includes at least one opening formed in the housing cover for access to a card underlying the housing cover inside the card chamber.

4. The quick access wallet of claim 2 wherein the card removal means comprises a slit in the housing cover, the slit being configured to slidably retain a button, the button having longitudinally sliding movement on a top surface of the housing cover, the button further comprising an ejecting member protruding downwards from its underside and being disposed under the housing cover and in the card chamber behind a plurality of cards, wherein the plurality of cards are able to be ejected from the card chamber by sliding the button forwards.

5. The quick access wallet of claim 1 wherein the transition portion of the second guide wall is angled approximately 45 degrees with respect to the interior surface of the bottom portion of the housing base.

6. The quick access wallet of claim 1 wherein the spring element further comprises a recess in the first guide wall, the recess comprising a sliding member and a spring, the recess being configured to slidably retain the sliding member, the sliding member partially projecting into the card chamber and having slidable movement into and out of the recess, the spring being retained between a back portion of the recess and a boss on the sliding member, the sliding member having a constant force against the edges of cards stored in the card chamber.

7. The quick access wallet of claim 1 wherein the exterior surface of the housing base comprises a card holding means.

8. The quick access wallet according to claim 1 wherein the housing cover is made from a substantially rigid RFID protective material.

9. A quick access wallet comprising:

a housing;

the housing comprising:

a housing base having a generally rectangular planar shape including a pair of longitudinal sides and a pair of transverse ends;

the housing base having a bottom portion having an interior surface and an exterior surface, a rear portion, and a front portion;

a housing cover having a generally rectangular planar shape and attached to the housing base, the housing cover covering the interior surface of the housing base;

the front portion of the housing base having a card opening formed therein configured to allow cards to pass through the card opening and into and out of a card chamber configured to receive at least one card, the interior surface of the bottom portion of the housing base forming a surface of the card chamber;

the card chamber having a first guide wall, a second guide wall, and a rear wall all upstanding from the interior surface of the housing base, the rear wall disposed between the first guide wall and the second guide wall proximate to the rear portion of the housing base;

the second guide wall having at least three portions, the three portions including a front portion of the second guide wall paralleling the first guide wall at a first predetermined distance and being proximate to the card opening, a recessed portion spaced at least a second predetermined distance from the first guide wall, and a transition portion joining the front portion of the second guide wall to the recessed portion, the second predetermined distance being greater than the first predetermined distance, the difference between the first predetermined distance and the second predetermined distance being 0.025" to 0.1875", the transition portion of the second guide wall being angled approximately 45 degrees with respect to the interior surface of the bottom portion of the housing base;

a spring element projecting from the first guide wall and into the card chamber for urging cards received within the card chamber towards the second guide wall to rotate and lock cards that are fully inserted into the card chamber against the recessed portion of the second guide wall, the transition portion of the second guide wall forming a physical barrier locking the cards in the card chamber against the recessed portion.

10. The quick access wallet of claim 9, wherein the wallet further comprises a card a removal means for urging cards received within the card chamber toward and out from the card opening.

11. The quick access wallet of claim 10 wherein the card removal means includes at least one opening formed in the housing cover for access to a card underlying the housing cover inside the card chamber.

12. The quick access wallet of claim 10 wherein the card removal means comprises a slit in the housing cover, the slit being configured to slidably retain a button, the button having longitudinally sliding movement on a top surface of the housing cover, the button further comprising an ejecting member protruding downwards from its underside and being disposed under the housing cover and in the card chamber behind a plurality of cards, wherein the plurality of cards are able to be ejected from the card chamber by sliding the button forwards.

13. The quick access wallet of claim 9 wherein the transition portion of the second guide wall is angled approximately 45 degrees with respect to the interior surface of the bottom portion of the housing base.

14. The quick access wallet of claim 9 wherein the spring element further comprises a recess in the first guide wall, the recess comprising a sliding member and a spring, the recess being configured to slidably retain the sliding member, the sliding member partially projecting into the card chamber and having slidable movement into and out of the recess, the spring being retained between a back portion of the recess and a boss on the sliding member, the sliding member having a constant force against the edges of cards stored in the card chamber.

15. The quick access wallet of claim 9 wherein the exterior surface of the housing base comprises a card holding means.

16. The quick access wallet according to claim 9 wherein the housing cover is made from a substantially rigid RFID protective material.

* * * * *